US007882892B2

(12) United States Patent
Svenning et al.

(10) Patent No.: US 7,882,892 B2
(45) Date of Patent: Feb. 8, 2011

(54) WELL HAVING INDUCTIVELY COUPLED POWER AND SIGNAL TRANSMISSION

(75) Inventors: Bjømar Svenning, Trondheim (NO); Bjarne Bugten, Hundhamaren (NO)

(73) Assignee: Statoil ASA, Stavanger (NO)

( * ) Notice: Subject to any disclaimer, the term of this patent is extended or adjusted under 35 U.S.C. 154(b) by 135 days.

(21) Appl. No.: 11/988,144

(22) PCT Filed: Jun. 28, 2006

(86) PCT No.: PCT/NO2006/000247

§ 371 (c)(1),
(2), (4) Date: Mar. 26, 2008

(87) PCT Pub. No.: WO2007/004891

PCT Pub. Date: Jan. 11, 2007

(65) Prior Publication Data

US 2009/0166023 A1 Jul. 2, 2009

(30) Foreign Application Priority Data

Jul. 1, 2005 (NO) ..... 20053252

(51) Int. Cl.
*G01V 3/06* (2006.01)
*G01V 3/18* (2006.01)

(52) U.S. Cl. ..... 166/65.1; 340/854.3; 340/855.8

(58) Field of Classification Search ..... 166/66, 166/65.1; 340/853.1, 855.8, 854.3, 854.4, 340/854.9

See application file for complete search history.

(56) References Cited

U.S. PATENT DOCUMENTS 4,727,223 A * 2/1988 Lee et al. ..... 174/151
4,839,644 A * 6/1989 Safinya et al. ..... 340/854.3
5,745,047 A * 4/1998 Van Gisbergen et al. . 340/853.1
6,633,236 B2 * 10/2003 Vinegar et al. ..... 340/854.4
6,644,403 B2 * 11/2003 Pichery et al. ..... 166/250.11
6,662,875 B2 * 12/2003 Bass et al. ..... 166/369
6,684,952 B2 * 2/2004 Brockman et al. ..... 166/250.03
7,170,424 B2 * 1/2007 Vinegar et al. ..... 340/855.8
2001/0035288 A1 11/2001 Brockman et al.
2004/0094303 A1 5/2004 Brockman et al.

FOREIGN PATENT DOCUMENTS

EP 0964134 A2 12/1999
WO WO-01/86117 A1 11/2001

* cited by examiner

*Primary Examiner*—Daniel P Stephenson
(74) *Attorney, Agent, or Firm*—Birch, Stewart, Kolasch & Birch, LLP

(57) ABSTRACT

Well for production of hydrocarbons, comprising a hole drilled down into an underground, a casing fastened to the hole wall, a production pipe that extends into the casing from the surface and down to a hydrocarbon-containing zone, a hanger on the surface in an upper end of the well, in which hanger the production pipe and casing are hung up and electrically short-circuited, and a packer arranged sealingly and electrically short-circuiting in the annulus between the production pipe and the casing, in or close to a lower end of the well, distinguished in that the well further comprises: a primary coil arranged concentrically about the production pipe, a secondary coil arranged concentrically about the production pipe, a load connected to the secondary coil, and an alternating current generator/signal unit connected to the primary coil.

27 Claims, 2 Drawing Sheets

WELL HAVING INDUCTIVELY COUPLED POWER AND SIGNAL TRANSMISSION

FIELD OF THE INVENTION

The present invention relates to signal and power transmission in operative wells for production of hydrocarbons.

BACKGROUND OF THE INVENTION AND PRIOR ART

When producing hydrocarbons from a well it is preferable to have knowledge of physical parameters of relevance to how the well is producing. Physical parameters can be measured at the wellhead, but it is strongly preferable to be able to take measurements into the well, preferably in production zones of the well.

Pressure is particularly interesting, but also many other physical parameters are of interest, such as temperature, composition and flow rates. Further, it can be of major interest to have valves, pumps or other means that require power and signals from the surface installed into the well.

In patent publication U.S. Pat. No. 6,644,403 B2 a method and a device are described for the measuring of physical parameters in a production well. Into the well, in an annulus between a production pipe and an exterior casing, a half-transformer is arranged in the annulus and a half-transformer is arranged in the production pipe. The half-transformer in the annulus has electrical connection by means of cables to the surface of the well. The half-transformer inside the production pipe is inductively coupled to the outer half-transformer and has connection to at least one sensor, an element for storage of energy, and electronic circuits, arranged inside the production pipe. The equipment situated in the annulus is permanently installed, while the equipment situated inside the production pipe can be replaced by light well intervention, such as by cable operations. Thus, the invention according to U.S. Pat. No. 6,644,403 B2 provides advantage by allowing for equipment arranged inside the production pipe to be replaced without comprehensive operations in the well being required.

In patent publication U.S. Pat. No. 6,515,592 B1 different methods and devices are described to send at least one electrical signal to or from at least one downhole device in a well. The downhole installed devices are permanently installed. Current is directed into a casing by use of a source at the surface connected to the casing. One or several permanent downhole devices are electrically connected to the casing, and the electrical connection to the casing is used to provide power to the downhole devices. The downhole devices also send out a signal to the isolated casing that can be directed via the casing to a surface-located receiving unit that receives and stores signals. The upper part of the casing closest to the surface is electrically insulated from the underlying part, and direct or inductive electrical connection is arranged from the surface unit to the underlying part. In the casing insulating gaps are provided, and underlying casing is connected by means of an electrical cable with a primary coil. A secondary coil with connected downhole devices are inductively coupled to the primary coil. In one embodiment effect and signal are passed down through an inner pipe and back through an outer pipe. Power and signals are sent to and from the permanently located downhole device by use of distinct frequencies and/or addressing. There is no description of inductive coupling to an inner production pipe, there is no description of measuring devices inside the inner pipe, and there is no description of short-circuiting between the outer and inner pipe in the upper end of a well, else than through a surface located generator/signal unit.

In patent application publication US 2004/0144530 A1 a ferromagnetic reactance-providing enveloping device and use thereof in a petroleum well are described, by which a voltage drop is developed over the reactance-providing enveloping device when an alternating current is passed through an interior pipe, and effect and signals are thereby taken out, used to drive and communicate with devices and sensors in the well. The reactance-providing enveloping device, a so-called choke, do not receive power and is prepared from a material having high relative magnetic permeability, for example in the range of 1,000 to 150,000, such as a ferromagnetic metal alloy or a ferrite. The choke is electrically isolated from the interior pipe and acts to provide a reactive impedance against the alternating currents in the pipe. The power and signal source at the surface is not inductively coupled to the well.

In patent publication U.S. Pat. No. 6,684,952 B2 a method and an apparatus are described, providing communication of electrical power and signals from downhole components to other downhole components, by use of an inductively coupled assembly. Concentric side-by-side primary and secondary coils are used, having connection from the surface through a cable to a primary coil close to equipment for measurement and/or control. More specifically, feedthrough of power and electrical signals through a liner/casing-wall without electrical leadthroughs is described, by the use of inductive coupling.

A demand exists for further development of the above-mentioned prior art, for implementation in a well without use of long cables, and with possibility for replacement of sensors and other sensitive equipment situated inside a production pipe. A particular demand exists for technology useful in wells that are short-circuited between the production pipe and the casing at the surface, with a hanger where said pipes are hung up, and short-circuited down into the well with a packer between said pipes, and particularly for connection to zones and equipment located further down into the well than the short-circuiting packer.

SUMMARY OF THE INVENTION

The above-mentioned demands are met by the present invention providing a well for production of hydrocarbons, comprising a hole drilled down into an underground, a casing fastened to the hole wall, a production pipe that extends into the casing from the surface and down to a hydrocarbon-containing zone, a hanger on the surface in an upper end of the well, in which hanger the production pipe and casing are hung up and electrically short-circuited, and a packer arranged sealingly and electrically short-circuiting in the annulus between the production pipe and the casing in or close to a lower end of the well, distinguished in that the well further comprises: a primary coil arranged concentrically about the production pipe; a secondary coil arranged concentrically about the production pipe; a load connected to the secondary coil; and an alternating current generator/signal unit connected to the primary coil.

The well according to the invention forms a closed electrical circuit by the production pipe and casing being coupled together at the hanger and the packer, said pipes being electrically insulated between the hanger and the packer. With the term "casing" is also meant sections of liners that are electrically short-circuited, so that the electrical circuit is maintained. The electrical circuit can even for a long well have a low ohmic loss, typically 1-10 ohm, which is important for the technical effect of the invention. Production pipes and casings in stainless steel, for example 13% Cr-steel, will be more preferable with respect to loss than so-called black steel. Production pipes are typically prepared from 13% Cr stainless steel.

The packer is preferably arranged sealingly and electrically short-circuiting in the annulus between the production pipe and casing at a level above the hydrocarbon-containing zone, to avoid leakage of electrically conductive fluids into the annulus above the packer.

The load preferably comprises an inductive feedthrough in the form of a divided transformer, with an outer part arranged outside the production pipe and an inner part releaseably arranged inside the production pipe, with connection from said inner part to sensors or means that are releaseably arranged inside the production pipe. In a preferable embodiment the load is arranged downward of the packer, connected with electrical cables fed through the packer from the load to the secondary coil. Thereby, only the load or selected components of the load are exposed to fluids from the hydrocarbon-containing zone.

The well according to the invention may comprise at least one zone further down into the well than the electrically short-circuiting packer, connected with cables from the secondary coil through the packer to a further primary coil arranged about the production pipe in said zone, and with a further secondary coil arranged about the production pipe in said zone, with a load connected to said further secondary coil. In or close to the end of said zone, it is assumed to be a short-circuiting packer or another short-circuiting between the production pipe and casing. Thereby, connection or zones that otherwise would be isolated blind zones relative to the rest of the well, is achieved.

The power signal is preferably transmitted at about 50 Hz and 50-250 V from the generator/signal unit, while signals preferably are transmitted at about 20-30 kHz and about 20 V from the generator/signal unit. The coils preferably have ferromagnetic cores arranged between the production pipe and the respective coil, to increase the magnetic field and thereby improve the inductive coupling to the well.

The well preferably comprises electrically isolating centralizers arranged in the annulus between the production pipe and the casing between the hanger and the packer, to avoid short-circuiting between said pipes.

The load may comprise one or more of a further primary coil, an electrically driven choke or control valve (choke valve), instrumentation for measurement of pressure, temperature, multiphase, composition, flow rate, flow velocity, a pump, a motor and a seismic sensor. Components susceptible to wear are preferably arranged replaceably and releaseably inside the production pipe. The load conveniently also comprises a power unit, for example in the form of a battery pack, circuits for coding/decoding, addressing, communication and control, appropriately chosen amongst and adapted from previously known equipment. The loads can preferably communicate with the signal unit, and optionally with other loads.

The well according to the invention preferably comprises several hydrocarbon producing zones, with load comprising instrumentation and an adjustable choke valve arranged in each zone. Thereby, controlled production can be achieved from each hydrocarbon producing zone, based on parameters measured with the instrumentation. The zones can be a part of the regular electrical circuit of the well, or be connected according to the invention.

DRAWINGS

The invention is illustrated with 3 figures, of which:

DETAILED DESCRIPTION

Figure 1:
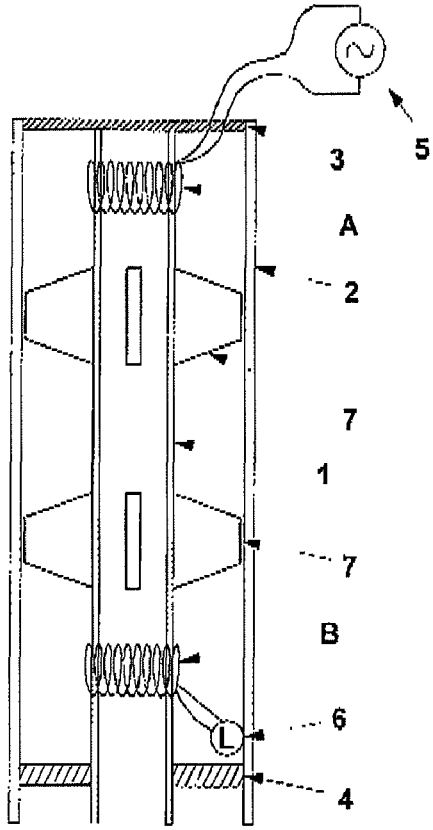
FIG. 1 is a schematic sketch of a well according to the present invention.

Reference is first made to FIG. 1, that illustrates a well comprising a production pipe 1 and a casing 2, the pipes at the well head being hung up in a so-called hanger 3 that provides electrical short-circuiting between the production pipe and the casing. A bit further down into the well a packer 4 is illustrated, arranged sealingly and electrically short-circuiting in the annulus between the production pipe and the casing. In the upper part of the well, around or about the production pipe, a primary coil A is arranged, connected with cable to a power generator/signal unit 5 at the surface of the well. Inside the well, about the production pipe, a secondary coil B is arranged, connected to a load 6. Between the hanger 3 and the packer 4 the production pipe 1 and the casing 2 are electrically isolated, by electrically isolating centralizers 7 arranged as required to hinder short-circuiting between the pipes. The annulus between the production pipe and the casing between the hanger and the packer is preferably filled with an electrically non-conductive fluid or medium, for example diesel oil, and/or the surface of the pipes has an electrically isolating coating applied.

The power generator/signal unit 5 generates electrical alternating current signals that are directed through the coil A, which result in inductive coupling to the production pipe 1, through which an electrical alternating current is generated. The coil B is an inductive coupling to the production pipe 1, such that an alternating voltage is generated over the coil B, connected to the load 6 for operation thereof. The well as such forms a closed electrical circuit, as the production pipe is coupled to the casing through the packer 4 and the hanger 3. Signals and power to and from the well are transmitted by use of the power generator/signal unit 5, and conveniently with the load 6, which may comprise its own power unit, electronic circuits and sensors, motors or other connected equipment. Signals transmitted from the load 6 are transferred by the coil B to the production pipe 1 and taken out with the coil A.

Figure 2:
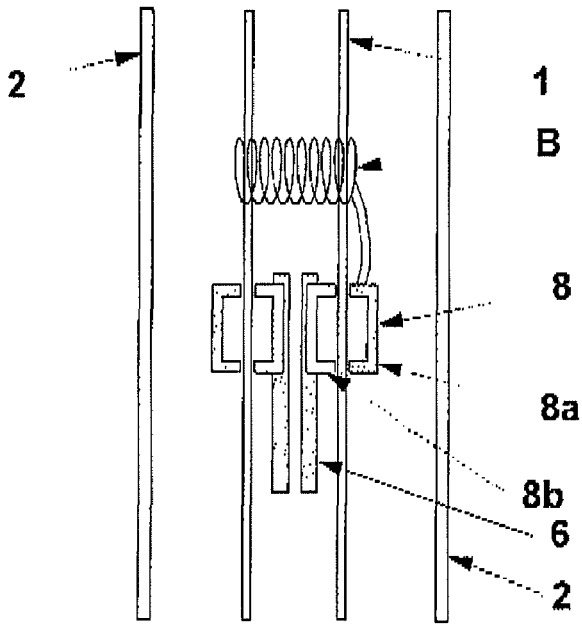
FIG. 2 illustrates an embodiment of the present invention, with a load that is replaceable by light well maintenance.

FIG. 2 illustrates how load that is replaceable by light well maintenance is arranged. More specifically, coil B is connected to a transformer 8 that consists of two half-transformers, more specifically the half-transformer 8*a* in the annulus, arranged On, around or partly embedded into the production pipe, and half-transformer 8*b* oppositely arranged inside the production pipe 1. The load 6 is arranged with connection to the half-transformer 8*b* inside the production pipe, and it can be replaced by light well maintenance, which means cable operations, coiled tubing operations or similar, without having to pull out the production pipe.

Figure 3:
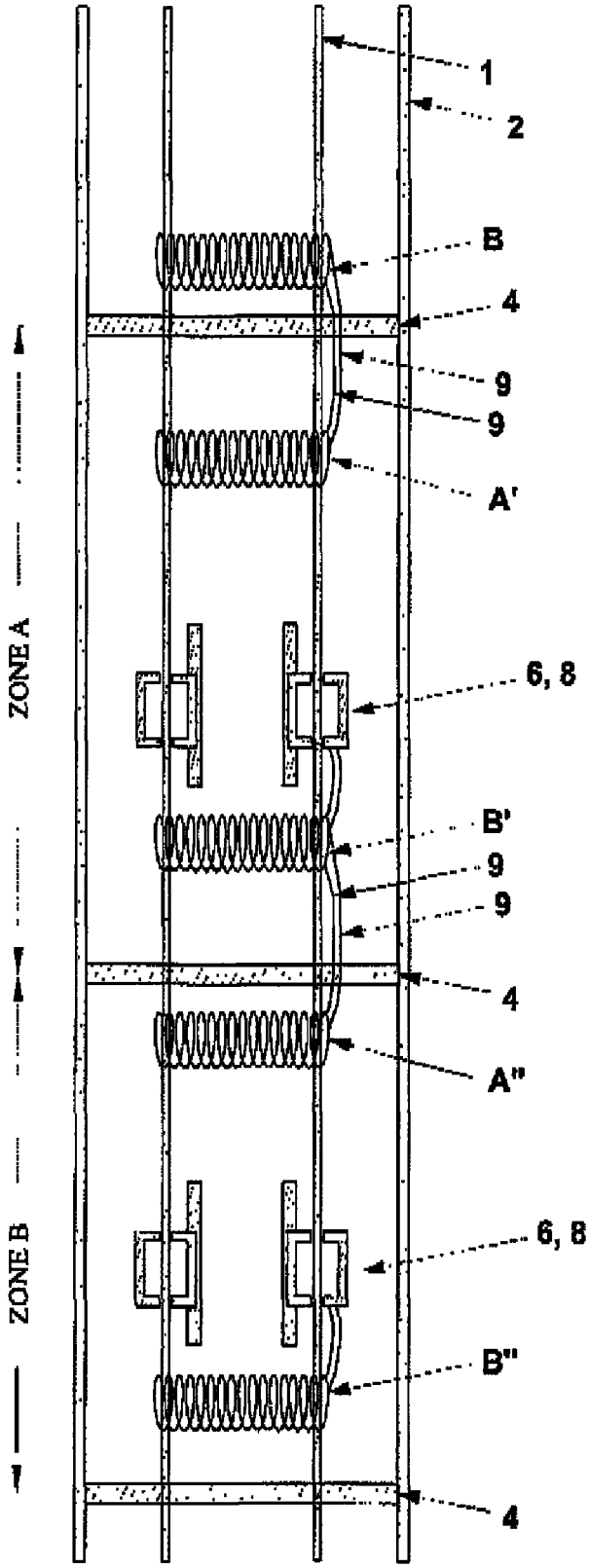
FIG. 3 illustrates an embodiment of the present invention, with feedthroughs to several zones, which zones are separated by electrically isolating packers.

Further reference is made to FIG. 3, that illustrates how instrumentation can be arranged in different zones in the well, which zones are further down into the well than the (upper) electrically short-circuiting packer 4. More specifically, the zones are coupled together by use of electrical feedthroughs 9 through the (lower) packers 4 to further primary and secondary coils, A', B', A" and B", respectively on FIG. 3. The zones can for example be hydrocarbon-producing zones in side branches of the well.

Tests in large scale have proved that an appropriate alternating current signal for power transmission is about 50 Hz, and frequency for the alternating current signal for signal transmission can appropriately be 20-30 kHz. Said frequencies can be departed from. For example, the power signal can conveniently be alternating current with frequency in the range 20-60 Hz. The signalling is preferably conducted at higher frequency, preferably in the kHz-range, to ensure sufficient resolution for the signal transmission. Tests have proved that an output signal of 30 kHz is more than sufficient to transmit data at a rate of 10-15 kbit/second, which is sufficient for transmission of the desired signals. Applied voltage for transmission of effect is typically 50-250 volt, while applied voltage for transmission of signal is typically 20 volt. Applied current is typically 0.1-0.5 A per coil. Typical output effect is about 50% of the input effect. The primary coil A can be one or several coils coupled in parallel, or one long coil, for example 7-10 m long, as a larger coil with more windings provides better transmission, likewise further or larger cores. Most preferably the primary coil is a number of identical coils with a ferrite core, which coils are arranged side-by-side and coupled in parallel, which is convenient with respect to manufacture, assembly and flexibility. The similar applies for the secondary coils, however, these may be of a smaller size than the primary coils, and with fewer windings, because of space considerations and because the secondary coils are not to transmit large effects. Coils that are coupled parallely are phase locked, such that they act together. The coils are typically embedded in a polymer to ensure mechanical stability. Increased loss by long wells can be compensated by applying larger effect, by increasing the number of cores in the coils, and with larger coils or increased number of side-by-side, identically, parallely coupled coils.

Example

A well of length 2 000 m shall have 1 kW transmitted from top to bottom. Tests prove that an efficiency of 50% is realistic. Therefore, 2 kW must be applied on the primary coil. A convenient primary coil will be about 8 m long and consist of 80 identical, side-by-side arranged and parallely coupled coils, each coil having about 250 windings of 0.2 $mm^2$ copper cable. By applying 220 V alternating current at 50 Hz and about 9.1 A on the primary coil, 25 W will be applied on each of the 80 coils which constitute the primary coil, with a current of 0.1 A in each of the 80 coils of the primary coil. The closed electrical circuit of the well, consisting of the production pipe and casing that are short-circuited at top and bottom of the well, can be considered as one winding, and the voltage and current in the closed electrical circuit then become respectively $80\times220/250=70.4$ V and $9.1\times250/80=28.43$ A, if losses are omitted. However, there are losses because of ohmic loss in the production pipe and casing, typically about 2 ohm for the actual well. If a secondary coil identical to the primary coil is used, and losses are omitted, at the secondary coil 220 V and about 9.1 A can be taken out. A loss of about 50% must be expected in a 2,000 m long well, for which reason only half the effect can be taken out at the secondary coil, for example 220 V and 4.55 A. Optimization of the equipment, in particular the coils, can be assumed to result in reduced loss. The well can be considered as two transformers, where the production pipe and casing form the secondary side to the primary coil, and the primary side to the secondary coil.

The conversion ratio between the coils, applied voltage, current, impedance, load and frequency, are of significance with respect to efficiency. However, parameters and components can be chosen within wide limits, with the proviso that power and signal transmission can be accomplished satisfactorily. For example, different types of load and the extent of connected load may have significant effect because of increased impedance.

The invention claimed is:

1. A well for production of hydrocarbons, comprising:
- a hole drilled down into an underground,
- a casing fastened to the hole wall,
- a production pipe that extends into the casing from the surface and down to a hydrocarbon-containing zone,
- a hanger on the surface in an upper end of the well, in which hanger the production pipe and casing are hung up and electrically short-circuited, and
- a packer arranged sealingly and electrically short-circuiting in the annulus between the production pipe and the casing, in or close to a lower end of the well, wherein the well further comprises:
- a primary coil arranged concentrically about the production pipe,
- a secondary coil arranged concentrically about the production pipe,
- a load connected to the secondary coil,
- an alternating current generator/signal unit connected to the primary coil, and
- at least one zone further down into the well than the electrically short-circuiting packer, connected with cables fed from the secondary coil through the packer to a further primary coil arranged about the production pipe in said zone, and with a further secondary coil arranged about the production pipe in said zone, with a load connected to said further secondary coil.

2. The well according to claim 1, wherein the packer is arranged sealingly and electrically short-circuiting in the annulus between the production pipe and casing at a level above the hydrocarbon-containing zone.

3. The well according to claim 1, wherein the load is arranged downward of the packer, connected with electrical cables fed through the packer from the secondary coil to the load.

4. The well according to claim 1, wherein the power signal is transmitted at about 50 Hz and 50-250 V from the generator/signal unit, while the signaling is transmitted at 20-30 kHz and about 20 V from the generator/signal unit.

5. The well according to claim 1, wherein electrically isolating centralizers are arranged in the annulus between the production pipe and casing between the hanger and the packer, to hinder short-circuiting between said pipes.

6. The well according to claim 1, wherein the coils have a ferromagnetic core arranged as a sleeve between the production pipe and the respective coil.

7. The well according to claim 1, wherein the load comprises one or more of a further primary coil, an electrically driven choke (choke valve), instrumentation for measurement of pressure, temperature, multiphase, composition, flow rate, flow velocity, a pump, a motor and a seismic sensor.

8. A well for production of hydrocarbons, comprising:
- a hole drilled down into an underground,
- a casing fastened to the hole wall,
- a production pipe that extends into the casing from the surface and down to a hydrocarbon-containing zone,
- a hanger on the surface in an upper end of the well, in which hanger the production pipe and casing are hung up and electrically short-circuited, and
- a packer arranged sealingly and electrically short-circuiting in the annulus between the production pipe and the casing, in or close to a lower end of the well, wherein the well further comprises:
- a primary coil arranged concentrically about the production pipe,
- a secondary coil arranged concentrically about the production pipe, a load connected to the secondary coil, an alternating current generator/signal unit connected to the primary coil, and several hydrocarbon-producing zones, with load comprising instrumentation and an adjustable choke valve arranged in each zone.

9. The well according to claim 8, wherein the packer is arranged sealingly and electrically short-circuiting in the annulus between the production pipe and casing at a level above the hydrocarbon-containing zone.

10. A well for production of hydrocarbons, comprising:

a hole drilled down into an underground, a casing fastened to the hole wall, a production pipe that extends into the casing from the surface and down to a hydrocarbon-containing zone, a hanger on the surface in an upper end of the well, in which hanger the production pipe and casing are hung up and electrically short-circuited, and a packer arranged sealingly and electrically short-circuiting in the annulus between the production pipe and the casing, in or close to a lower end of the well, wherein the well further comprises:

a primary coil arranged concentrically about the production pipe, a secondary coil arranged concentrically about the production pipe, a load connected to the secondary coil, and an alternating current generator/signal unit connected to the primary coil, and wherein the load comprises an inductive feed-through in the form of a divided transformer, with an outer part arranged outside the production pipe and an inner part arranged releasably inside the production pipe, with coupling from said inner part to sensors or means that are releasably arranged inside the production pipe.

11. The well according to claim 10, wherein the packer is arranged sealingly and electrically short-circuiting in the annulus between the production pipe and casing at a level above the hydrocarbon-containing zone.

12. The well according to claim 10, wherein the load is arranged downward of the packer, connected with electrical cables fed through the packer from the secondary coil to the load.

13. The well according to claim 10, wherein the well comprises at least one zone further down into the well than the electrically short-circuiting packer, connected with cables fed from the secondary coil through the packer to a further primary coil arranged about the production pipe in said zone, and with a further secondary coil arranged about the production pipe in said zone, with a load connected to said further secondary coil.

14. The well according to claim 10, wherein the power signal is transmitted at about 50 Hz and 50-250 V from the generator/signal unit, while the signaling is transmitted at 20-30 kHz and about 20 V from the generator/signal unit.

15. The well according to claim 10, wherein electrically isolating centralizers are arranged in the annulus between the production pipe and casing between the hanger and the packer, to hinder short-circuiting between said pipes.

16. The well according to claim 10, wherein the coils have a ferromagnetic core arranged as a sleeve between the production pipe and the respective coil.

17. The well according to claim 10, wherein the load comprises one or more of a further primary coil, an electrically driven choke (choke valve), instrumentation for measurement of pressure, temperature, multiphase, composition, flow rate, flow velocity, a pump, a motor and a seismic sensor.

18. The well according to claim 10, wherein the well comprises several hydrocarbon-producing zones, with load comprising instrumentation and an adjustable choke valve arranged in each zone.

19. A well for production of hydrocarbons, comprising:

a hole drilled down into an underground, a casing fastened to the hole wall, a production pipe that extends into the casing from the surface and down to a hydrocarbon-containing zone, a hanger on the surface in an upper end of the well, in which hanger the production pipe and casing are hung up and electrically short-circuited, and a packer arranged sealingly and electrically short-circuiting in the annulus between the production pipe and the casing, in or close to a lower end of the well, wherein the well further comprises:

a primary coil arranged concentrically about the production pipe, a secondary coil arranged concentrically about the production pipe, a load connected to the secondary coil, and an alternating current generator/signal unit connected to the primary coil, and wherein the primary coil and the secondary coil each comprise two or more coils coupled in parallel and mutually phase locked.

20. The well according to claim 19, wherein the packer is arranged sealingly and electrically short-circuiting in the annulus between the production pipe and casing at a level above the hydrocarbon-containing zone.

21. The well according to claim 19, wherein the load is arranged downward of the packer, connected with electrical cables fed through the packer from the secondary coil to the load.

22. The well according to claim 19, wherein the well comprises at least one zone further down into the well than the electrically short-circuiting packer, connected with cables fed from the secondary coil through the packer to a further primary coil arranged about the production pipe in said zone, and with a further secondary coil arranged about the production pipe in said zone, with a load connected to said further secondary coil.

23. The well according to claim 19, wherein the power signal is transmitted at about 50 Hz and 50-250 V from the generator/signal unit, while the signaling is transmitted at 20-30 kHz and about 20 V from the generator/signal unit.

24. The well according to claim 19, wherein electrically isolating centralizers are arranged in the annulus between the production pipe and casing between the hanger and the packer, to hinder short-circuiting between said pipes.

25. The well according to claim 19, wherein the coils have a ferromagnetic core-arranged as a sleeve between the production pipe and the respective coil.

26. The well according to claim 19, wherein the load comprises one or more of a further primary coil, an electrically driven choke (choke valve), instrumentation for measurement of pressure, temperature, multiphase, composition, flow rate, flow velocity, a pump, a motor and a seismic sensor.

27. The well according to claim 19, wherein the well comprises several hydrocarbon-producing zones, with load comprising instrumentation and an adjustable choke valve arranged in each zone.

* * * * *

UNITED STATES PATENT AND TRADEMARK OFFICE

CERTIFICATE OF CORRECTION

PATENT NO. : 7,882,892 B2
APPLICATION NO. : 11/988144
DATED : February 8, 2011
INVENTOR(S) : Bjørnar Svenning et al.

It is certified that error appears in the above-identified patent and that said Letters Patent is hereby corrected as shown below:

ON THE TITLE PAGE:

At item (75), Inventors, change "Bjømar Svenning, Trondheim (NO)" to --Bjørnar Svenning, Trondheim (NO)--.

Signed and Sealed this
Eleventh Day of August, 2015

Michelle K. Lee

Michelle K. Lee
*Director of the United States Patent and Trademark Office*